US005704423A

United States Patent [19]

Letrange

[11] Patent Number: 5,704,423

[45] Date of Patent: Jan. 6, 1998

[54] FLAT TUBE FOR HEAT EXCHANGER

[75] Inventor: Frédéric Letrange, Nanterre, France

[73] Assignee: Valeo Thermique Moteur, La Verriere, France

[21] Appl. No.: 793,245

[22] PCT Filed: Aug. 18, 1996

[86] PCT No.: PCT/FR96/00939

§ 371 Date: Feb. 21, 1997

§ 102(e) Date: Feb. 21, 1997

[87] PCT Pub. No.: WO97/01071

PCT Pub. Date: Jan. 9, 1997

[30] Foreign Application Priority Data

Jun. 22, 1995 [FR] France ..... 95 07513

[51] Int. Cl.[6] ..... F28F 1/00

[52] U.S. Cl. ..... 165/17.7; 165/183; 165/906; 29/890.053; 138/117; 138/163

[58] Field of Search ..... 165/906, 177, 165/183; 29/890.053; 138/163, 162, 117, 116, 115, 38

[56] References Cited

U.S. PATENT DOCUMENTS

| | | | |
|---|---|---|---|
| 4,222,372 | 9/1980 | Bogatzki | 165/177 X |
| 4,805,693 | 2/1989 | Flessate | 165/153 |
| 5,186,251 | 2/1993 | Joshi | 165/906 X |
| 5,441,105 | 8/1995 | Brummett et al. | 165/177 X |
| 5,441,106 | 8/1995 | Yukitake | 165/177 X |
| 5,511,613 | 4/1996 | Mohn et al. | 165/906 X |

FOREIGN PATENT DOCUMENTS

| | | | |
|---|---|---|---|
| 302232 | 2/1989 | European Pat. Off. . | |
| 1573193 | 5/1969 | France . | |
| 805785 | 5/1951 | Germany . | |
| 406123571 | 5/1994 | Japan | 165/177 |

*Primary Examiner*—Denise L. Ferensic
*Assistant Examiner*—Christopher Atkinson
*Attorney, Agent, or Firm*—Morgan & Finnegan L.L.P.

[57] ABSTRACT

A flat tube for a heat exchanger is disclosed. The flat tube is produced by assembling a main part made of a folded metal strip defining a flat side, two rounded ends and two side portions with two free edges, as well as a secondary part made of a metal strip forming a central portion with two flanged free edges, whereby the secondary part is sandwiched into the main part to form a multichannel tube. The tube may be used in heat exchangers for motor vehicle heating and/or air conditioning systems.

20 Claims, 1 Drawing Sheet

FLAT TUBE FOR HEAT EXCHANGER

Figure 1:
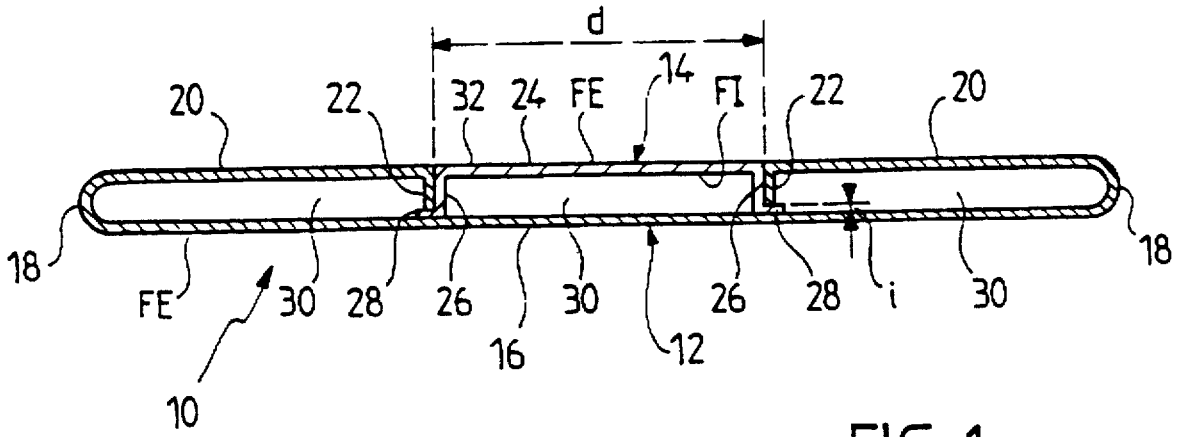

The invention relates to a flat tube for a heat exchanger, especially of a motor vehicle heating and/or air conditioning system or for a motor vehicle cooling system.

It relates more particularly to a flat tube of the type comprising two opposed flat sides joined together by two rounded sides and by at least two longitudinal internal partitions to define flow ducts in the tube.

Such flat tubes, also known as "multi-duct tubes" are arranged in parallel to form a bundle, which also comprises wavy spaces, forming fins, arranged between the tubes.

These tubes are intended to have a heat-transfer fluid which may be water or a refrigerant flowing through them.

In particular, these multi-duct tubes my be used to form a condenser of an air conditioning system and then have a refrigerant passed through them. This refrigerant may be at a high pressure.

The internal partitions of the tubes in such cases are used to stiffen the tube and prevent it from deforming under the effect of the high pressure of the refrigerant.

For some applications the partitions make it possible to define flow ducts which can have different fluids passing through them, possibly in counter-current mode.

European Patent No. 0 302 232 already makes known a flat tube of this type which is obtained from a metal strip subjected to several successive rolling operations to form the two flat sides, the two rounded sides and the two edges bent into a U, which are brazed together and to one of the large sides, in order thus to form two flow ducts.

One of the main problems encountered in the manufacture of this known tube is that of producing the edges bent into a U. This is because these bent edges are tricky to make and there is a risk of causing cracks to start.

Furthermore, this known tube has the drawback that it allows the production only of flat tubes having just one internal partition thus delimiting just two flow ducts.

The object of the invention is especially to overcome the aforementioned drawbacks.

It therefore proposes a flat tube of the type defined in the introduction, which is formed by assembling and brazing two complimentary pieces which comprise:

- a first piece, or main piece formed from a bent metal strip and constituting a first flat side, the two rounded sides and two lateral segments connected respectively to the two rounded sides in order partially to form the second flat side, the two lateral segments ending respectively at two free edges which are distant from one another and bent toward the first flat side; and
- a second piece or secondary piece formed from a bent metal strip and constituting a central segment capable of partially forming the second flat side, the central segment ending at two free edges bent on the same side of the said central segment in such a way that the free edges of the central segment can press against the free edges of the lateral segments to hold the secondary piece sandwiched in the main piece, and that the main segment and the lateral segments together form the second flat side of the tube.

The tube is thus obtained by assembling and brazing two complimentary pieces which fit closely one inside the other, the main piece sandwiching the secondary piece.

These two pieces can be obtained easily by mechanical deformation, this being achieved in practice by successive rolling operations, starting from a metal strip.

When the two pieces have been assembled and brazed, they constitute one and the same tube which comprises two internal partitions and therefore three flow ducts which run parallel to each other.

In a preferred embodiment of the invention, each of the free edges of the main piece is bent at right angles with respect to the corresponding lateral segment and stops some distance from the first flat side leaving a gap of given size.

Advantageously, each of the free edges of the secondary piece is bent at right angles with respect to the central segment and ends in a lip which is practically parallel to the central segment and which can be inserted into a corresponding gap in the main piece, which allows the two pieces to fit together closely.

As a preference, the size of the gap is substantially equal to the thickness of the metal strip of which the secondary piece is formed, which allows close assembly.

Advantageously, the metal strip of the main piece is equipped with a plaque of brazing metal on one of its faces, or outer face, and this makes it possible on the one hand to form a soldered joint with the secondary piece and, on the other hand, to form a run of solder with the fins of the exchanger.

According to another feature of the invention, the metal strip of the secondary piece is equipped with a plaque of brazed metal on both its faces, and this makes it possible on the one hand to obtain a run of solder with the main piece and on the other hand to provide a run of solder with the fins of the heat exchanger.

Figure 2:
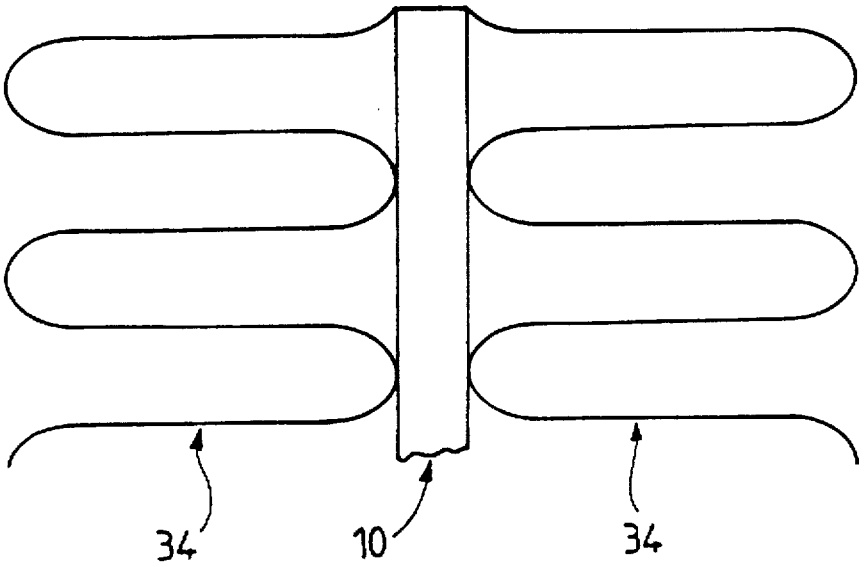

In the description which follows, given merely by way of example, reference is made to the attached drawing, in which:

FIG. 1 is a view in transverse section of a flat tube according to the inventions; and FIG. 2 is a partial side view of a heat exchanger comprising flat tubes according to the invention, spaced apart with fins.

The flat tube represented in transverse section in FIG. 1 is formed by assembling and brazing two complimentary pieces, namely a main piece 12 and a secondary piece 14.

The main piece 12 is formed from a metal strip, for example of aluminum or aluminum alloy, bent by several successive rolling operations. The piece 12 comprises a first flat side 16 flanked by two rounded sides 18 of semicircular shape which are connected respectively to two lateral segments 20 of the flat configuration.

The two lateral segments 20 are parallel to the flat side 16 and each has a width which corresponds practically to one third of the width of the flat side 16. Each lateral segment 20 ends at a free edge 22 bent at right angles toward the inside of the flat side 16. The two free edges 22 are parallel to each other and separated by a distance d which is practically equal to one third of the width of the flat side 16. Each of the free edges 22 stops some distance away from the flat side 16 leaving a gap i of given size which is substantially equal to the thickness of the metal strip of which the secondary piece 14 is formed. This thickness is, in practice, the same as that of the metal sheet of which the main piece 12 is formed.

The secondary piece 14 is formed from a bent metal strip, for example of aluminum or aluminum alloy, obtained by several successive rolling operations. The piece 14 comprises a central segment 24 of flat configuration, the width of which is practically equal to the aforementioned distance d.

This central segment 24 ends at two free edges 26 bent at right angles so that they extend parallel to each other. Each of the free edges 26 is continued by a lip 28 which is perpendicular to the edge 26 and therefore parallel to the segment 24. The two lips 28 are coplanar and extend in opposite directions.

The result of this is that the secondary piece 14 may be sandwiched inside the main piece 12 in the position represented in FIG. 1.

In this position, each of the edges 26 of the piece 14 comes to bear against a corresponding edge 22 of the piece 12, while each of the lips 28 fits into a gap i of the piece 12. The two pieces may be fitted together in a longitudinal direction, or alternatively by slightly deforming at least one of the two pieces.

After assembly, each edge 22 forms with the edge 26 and the corresponding lip 28 [sic] an internal partition such that the tube is split into three ducts 30 which run parallel to each other.

When the two pieces are assembled, the central segment 14 and the two lateral segments 20 are coplanar and thus form a second flat side 32 of the flat tube, which runs parallel to the first flat side 16.

The metal strip of which the main piece 12 is formed is equipped with a plaque of brazing metal on its outer face FE to allow the formation of a soldered joint with the secondary piece 14. This also makes it possible to obtain a run of solder for linking the tube with the fins 34, as shown in FIG. 2.

Moreover, the metal strip of which the secondary piece 14 is formed is equipped with a plaque of brazing metal on its outer face FE and on its inner face FI. This makes it possible to obtain a run of solder between the two lips 28 and the inside of the flat side 16.

That also makes it possible to obtain a run of solder between the edges 22 and 26 and also a run of solder with the fins 34 of a heat exchanger, as shown in FIG. 2.

The invention is not limited to the embodiment described previously, and extends to cover other alternative forms.

It will be noted especially that the presence of the lips 28 is optional. However, this presence is preferable to make it easier temporarily to hold the two pieces for the brazing operation.

The flat tube according to the invention is intended for the production of heat exchangers, especially for motor vehicle heating and/or air conditioning systems.

I claim:

1. A flat tube for a heat exchanger having two opposed flat sides joined together by two rounded sides and by at least two longitudinal internal partitions to define flow ducts, the tube comprising:

a main piece formed from a bent metal strip and constituting a first flat side, the two rounded sides and two lateral segments connected respectively to the two rounded sides in order partially to form the second flat side, the two lateral segments ending respectively at two free edges which are distant from one another and bent toward the first flat side; and a secondary piece formed from a metal strip and constituting a central segment capable partially of forming the second flat side, the central segment ending at two free edges bent on the same side of the said central segment in such a way that the two free edges of the central segment can press against the free edges of the lateral segments to hold the secondary piece sandwiched in the main piece, and that the central segment and the two lateral segments together form the second flat side of the tube.

2. A flat tube according to claim 1, wherein each of the free edges of the main piece is bent at right angles with respect to the corresponding lateral segment and stops some distance from the first flat side leaving a gap of given size.

3. A flat tube according to claim 2, wherein each of the free edges of the secondary piece is bent at right angles with respect to the central segment and ends in a lip which is practically parallel to the central segment and which can be inserted into the gap in the main piece.

4. A flat tube according to claim 2, wherein the size of the gap is substantially equal to the thickness of the metal strip of which the secondary piece is formed.

5. A flat tube according to claim 1, wherein the main piece and the secondary piece are obtained by successive rolling operations.

6. A flat tube according to claim 1, wherein the metal strip of which the main piece is formed is equipped with a plaque of brazing metal on one of its faces which extends outward.

7. A flat tube according to claim 1, wherein the metal strip of which the secondary piece is formed is equipped with a plaque of brazing metal on both of its faces.

8. A flat tube according to claim 3, wherein the size of the gap is substantially equal to the thickness of the metal strip of which the secondary piece is formed.

9. A flat tube according to claim 2, wherein the main piece and the secondary piece are obtained by successive rolling operations.

10. A flat tube according to claim 3, wherein the main piece and the secondary piece are obtained by successive rolling operations.

11. A flat tube according to claim 4, wherein the main piece and the secondary piece are obtained by successive rolling operations.

12. A flat tube according to claim 2, wherein the metal strip of which the main piece is formed is equipped with a plaque of brazing metal on one of its faces which extends outward.

13. A flat tube according to claim 3, wherein the metal strip of which the main piece is formed is equipped with a plaque of brazing metal on one of its faces which extends outward.

14. A flat tube according to claim 4, wherein the metal strip of which the main piece is formed is equipped with a plaque of brazing metal on one of its faces which extends outward.

15. A flat tube according to claim 5, wherein the metal strip of which the main piece is formed is equipped with a plaque of brazing metal on one of its faces which extends outward.

16. A flat tube according to claim 2, wherein the metal strip of which the secondary piece is formed is equipped with a plaque of brazing metal on both of its faces.

17. A flat tube according to claim 3, wherein the metal strip of which the secondary piece is formed is equipped with a plaque of brazing metal on both of its faces.

18. A flat tube according to claim 4, wherein the metal strip of which the secondary piece is formed is equipped with a plaque of brazing metal on both of its faces.

19. A flat tube according to claim 5, wherein the metal strip of which the secondary piece is formed is equipped with a plaque of brazing metal on both of its faces.

20. A flat tube according to claim 6, wherein the metal strip of which the secondary piece is formed is equipped with a plaque of brazing metal on both of its faces.

* * * * *

UNITED STATES PATENT AND TRADEMARK OFFICE

CERTIFICATE OF CORRECTION

PATENT NO. : 5,704,423

DATED : January 6, 1998

INVENTOR(S) : Frédéric Latrange

It is certified that error appears in the above-identified patent and that said Letters Patent is hereby corrected as shown below:

On the cover sheet item [22] should read PCT Filed: June 18, 1996.

Signed and Sealed this

Seventeenth Day of March, 1998

Bruce Lehman

*Attest:*

BRUCE LEHMAN

*Attesting Officer*

*Commissioner of Patents and Trademarks*